US005415589A

United States Patent [19]

Hall, Jr.

[11] Patent Number: 5,415,589

[45] Date of Patent: May 16, 1995

[54] VARIABLE MOTION DEVICE

[76] Inventor: Rudolph V. Hall, Jr., 220 Bruce St., Simpsonville, S.C. 29681

[21] Appl. No.: 92,607

[22] Filed: Jul. 16, 1993

[51] Int. Cl.[6] ..... A63G 1/32; A63G 1/38

[52] U.S. Cl. ..... 472/25; 472/135

[58] Field of Search ..... 472/5, 19, 25, 27, 106, 472/107, 4, 25, 135, 95

[56] References Cited

U.S. PATENT DOCUMENTS

| | | | |
|---|---|---|---|
| D. 152,524 | 2/1949 | Flatt | 472/135 X |
| 2,615,495 | 10/1952 | Hilliker | 472/25 |
| 2,804,123 | 8/1957 | Kling | 472/25 |
| 2,878,858 | 3/1959 | Winchester | 472/25 |
| 2,920,889 | 1/1960 | Keeling . | |
| 3,024,021 | 3/1962 | Coplin et al. | 472/25 |
| 3,220,744 | 11/1965 | Gomory et al. | 472/25 |
| 3,268,223 | 8/1966 | Woodsum, Jr. . | |
| 3,389,910 | 6/1968 | Kanzler, Jr. | 472/25 |
| 3,397,881 | 8/1968 | Hedgecock . | |
| 3,441,271 | 4/1969 | Palacios . | |
| 3,451,673 | 6/1969 | Matson | 472/25 |
| 3,477,713 | 11/1969 | Cudmore | 472/25 |
| 3,594,944 | 7/1971 | Rondeau et al. . | |
| 3,612,520 | 10/1971 | Chang | 472/95 |
| 3,749,399 | 7/1973 | Fedor | 472/25 |
| 4,025,107 | 5/1977 | Chippa | 472/25 X |
| 4,084,273 | 4/1978 | Haynes | 472/25 X |
| 4,431,183 | 2/1984 | Reimann . | |
| 4,605,224 | 8/1986 | Torii . | |
| 4,924,718 | 5/1990 | Glover . | |
| 4,953,849 | 9/1990 | Reed . | |
| 4,995,603 | 2/1991 | Reed | 472/60 |

FOREIGN PATENT DOCUMENTS

| | | | |
|---|---|---|---|
| 624069 | 11/1962 | Belgium | 472/25 |
| 654569 | 12/1912 | Canada | 472/25 |
| 985069 | 3/1965 | United Kingdom | 472/25 |
| 265940 | 9/1965 | United Kingdom | 472/25 |

*Primary Examiner*—Carl D. Friedman
*Assistant Examiner*—Beth A. Aubrey
*Attorney, Agent, or Firm*—Richard Litman

[57] ABSTRACT

A variable motion device displaying interactive rocking and rotating motion and having a geometrically eccentric center of mass. The device is supported upon a teetering surface bearing against a corresponding counterteetering surface. At least one of these surfaces is curved, so that the device wobbles. These features, which are concealed from an observer, cause compound or unpredictable precession in response to the device being rocked or similarly moved by a rider. Further ride altering effects are produced by powered pushing or pulling devices. In another alternative embodiment, initial rotation is produced by a powered source. The device, which finds its best application as an amusement ride, accommodates one or more riders.

3 Claims, 6 Drawing Sheets

VARIABLE MOTION DEVICE

BACKGROUND OF THE INVENTION

1. Field of the Invention

The present invention relates to a variable motion device wherein input rocking and rotating motion are imparted thereto, and the device responds with compound or unexpected alterations, primarily precession, to the initial motion. A preferred application is amusement rides.

2. Description of the Prior Art

Amusement rides essentially powered by the user are exemplified by U.S. Pat. Nos. 2,920,889, issued to Wilmer B. Keeling on Jan. 12, 1960, and 3,268,223, issued to Harold C. Woodsum, Jr. on Aug. 23, 1966. Keeling provides a seat located at the end of a Dole pivotally mounted at a base, and constrained to move within limits dictated by a circular travel area. Woodsum discloses a seat for one or more occupants mounted atop a pole which is solidly anchored to a floor or base. The seat member moves in whipsaw motion responsive to flexing of the pole.

A small carousel is seen in U.S. Pat. No. 3,397,881, issued to Henry F. Hedgecock on Aug. 20, 1968. The carousel is supported on a central stake driven into the ground below.

The above amusement rides do not provide compound or unexpected motions.

U.S. Pat. No. 3,441,271, issued to Richard Palacios on Apr. 29, 1969, discloses an exerciser providing a plurality of rotating platforms, each supported on ball bearings. Although each platform rotates independently of the others, no compound motion is provided. Another exercise device is seen in U.S. Pat. No. 4,605,224, issued on Aug. 12, 1986 to Masakatsu Torii. The device has a platform mounted on an inverted dome, thus wobbling in response to movement by the person exercising. Movement of the device is responsive to balance and bodily control of the user, no unpredictable motions being present apart from abrupt response to the user's movement.

Irregular and unexpected motions are exhibited by a top, disclosed in U.S. Pat. No. 3,594,944, issued to Herbert F. Rondeau et al. on Jul. 27, 1971. The subject of this patent is a spinning toy top, and not an amusement ride. A general purpose device for producing omnidirectional rotation, but no random or unpredictable rotation, is seen in U.S. Pat. No. 4,924,718, issued on May 15, 1990 to Marvin J. Glover.

U.S. Pat. No. 4,431,183, issued on Feb. 14, 1984 to Paul E. Reimann, discloses a training or amusement device which is suspended from above. The device rotates and can simultaneously bob up and down on its suspension means.

An amusement ride having a partially enclosed seat is seen in U.S. Pat. No. 4,953,849, issued to Victoria K. Reed on Sep. 4, 1990. The seat is supported on a member having a convex surface teetering on a base member having a convex surface of greater radius of curvature. No compound or unexpected component is asserted to be present in the tilting and rotation produced by the ride.

None of the above inventions and patents, taken either singly or in combination, is seen to describe the instant invention as claimed.

SUMMARY OF THE INVENTION

A variable motion device includes a rotatable, rocking body supported on a fixed base, and constrained to pivot about a single point thereupon. The device spins in the manner of a top, exhibiting gyroscopic precession, but is constrained to remain substantially erect, and not to wander.

Precession is varied by concealed inputs. Static inputs include eccentrically located weights, which cause the body center of mass to be eccentrically located with respect to a geometric center, and a curved, and, particularly, irregularly curved, support surface. Since the body is supported on a base, either the body or the base may include the curved surface. This surface bears against a corresponding surface disposed upon the other of the two respective components.

The surfaces are preferably spaced apart by bearings, fluid lubrication, magnetic force, or by other friction reducing means. The surfaces are arranged so that one surface provides boundaries, established by mechanical interference, limiting travel of the body with respect to the base.

A preferred application is that of amusement rides. The body is formed to provide seating for one or more occupants. Motion is provided by the rider or by an external power source, and is predictably or unpredictably varied by the static inputs described above, by dynamic inputs, or both. Dynamic inputs include forces imposed by a rider, or by powered apparatus provided to supply forces.

The device is preferably rotated by a rider or by a rotary power source, such as a motor. This rotation is readily perceptible, but static and dynamic input devices are concealed. The device thus exhibits motion including a predictable component thereof, and at least one unpredictable component thereof. The resultant nature of the ride, as it rocks and rotates in seemingly random patterns, affords amusement both to riders and to onlookers, A second application is to standard flywheels, Unpredictable motion is employed to create life like animation of mechanically operated dolls or the like.

The same principle is also applicable to a standard armature or rotor, which is made to move irregularly or randomly, so that generated voltages or magnetic flux are irregular. The output can be used in random number generation, as a frequency modulator as for secured channel broadcasting, and for other purposes requiring irregular output.

Accordingly, it is a principal object of the invention to provide a variable motion device which exhibits gyroscopic precession when influenced selectively by torque and torsion.

A second major object of the invention is to provide a variable motion device which exhibits varied interactive rocking and rotating motion.

A further important object of the invention is to provide a variable motion device which exhibits motion which is not readily discernible to an observer.

Another object of the invention is to provide an amusement ride.

A further object of the invention is to provide an amusement ride having means to provide compound or unexpected motion characteristics which means are manually adjustable by and readily accessible to a ride operator.

It is another object of the invention to provide automatically acting means to provide compound or unexpected motion characteristics, which means are actuated upon teetering or rocking of the ride.

It is a further object of the invention to provide a variable motion device having swivel means enabling rotation and rocking thereof while supporting a substantial portion of the weight of the device on a bearing.

Yet a further object of the invention is to include a member providing a hard, smooth floor surface to enable the device to be operable as an amusement ride on an uneven environmental surface, such as a lawn.

Still another object of the invention is to provide a means limiting the degree of inclination of the device.

Yet another object of the invention is to provide an amusement ride having power means to operate, whereby motion is not dependent upon input from a rider.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
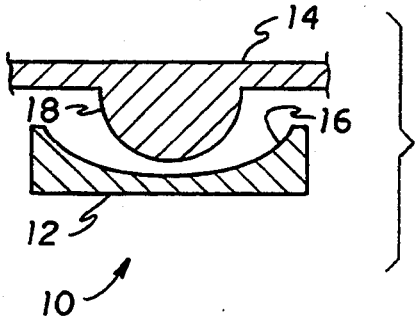
FIG. 1 is a cross sectional, side elevational detail view of the present invention.

The variable motion device 10 of the present invention is seen in FIG. 1 to comprise a stationary base 12 and a mobile, or teetering, member 14. Although separated in the depiction of FIG. 1, teetering member 14 rests on and contacts base 12. Base 12 has a surface 16 which faces teetering member 14, and teetering member 14 has a corresponding surface 18 facing base 12. Because surfaces 16 and 18 interact to influence motion, they will be referred to as teetering surface 16 and counterteetering surface 18, respectively. In the absence of further structure, surfaces 16 and 18 would contact one another, and member 14 would rock and rotate on teetering surface 16.

Figure 2:
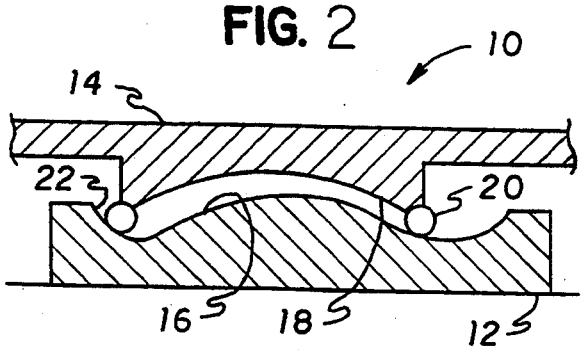
FIG. 2 is a cross sectional, side elevational detail view of a second embodiment of the present invention.

In practice, surfaces 16 and 18 will be separated in all but the simplest forms in which the invention is practiced. Separation means are provided by ball bearings 20, as illustrated in FIG. 2. Bearings 20 are fixed to teetering member 14 by a suitable bracket (not shown). It would also be possible to provide other separation means (not shown) relying on reduced friction, including fluid lubricants such as oil, pressurized water, or a film of gas forced under pressure between surfaces 16 and 18. Still another example of separation means would include opposing magnetic fields (not shown).

Base 12 includes curved walls 22 limiting travel of teetering member 14 by interference with bearings 20 or with counterteetering surface 16, where bearings 20 are not employed.

Figure 3:
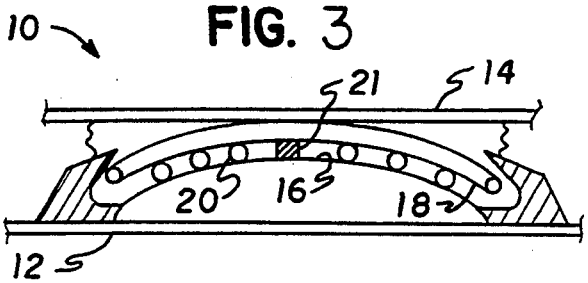
FIG. 3 is a partly cross sectional, side elevational view of an alternative embodiment of the present invention, wherein weight is borne on a central swivel bearing.

As illustrated in FIG. 3, an additional swivel bearing 21 is employed to limit movement and to carry a major portion of the weight or load.

Figure 4:
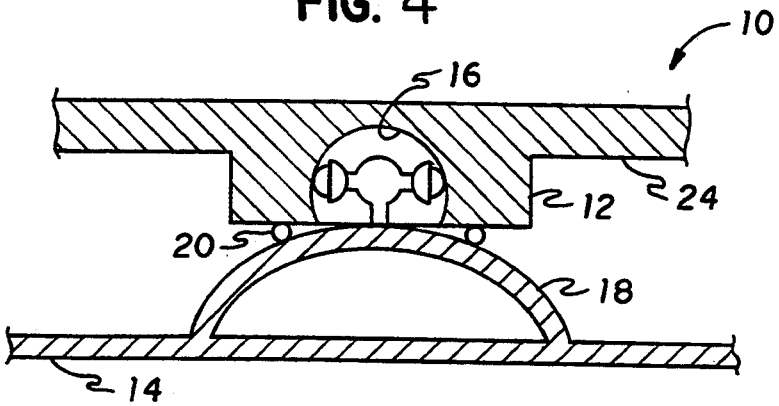
FIG. 4 is a partly cross sectional, side elevational detail view of an alternative embodiment wherein the invention depends from a ceiling surface.

As seen in FIG. 4, teetering member 14 is, in an alternative embodiment, suspended from above. Base 12 is mounted to a ceiling surface 24 in this embodiment.

Figure 5:
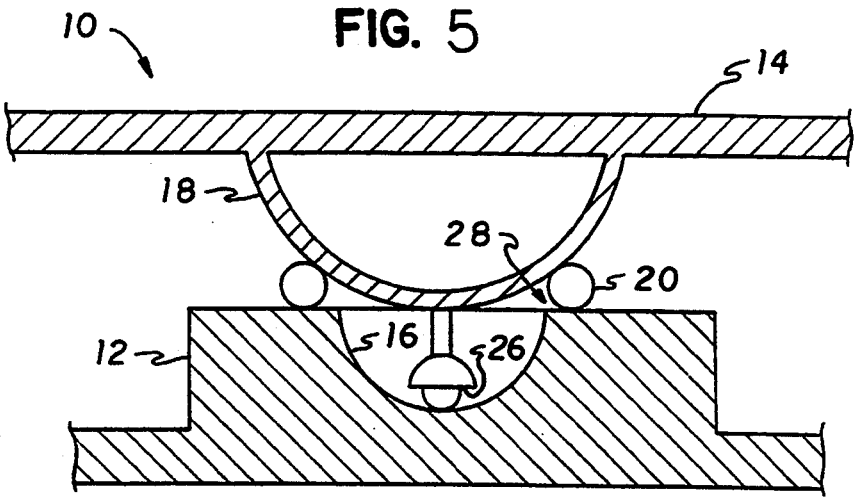
FIG. 5 is a partly cross sectional, side elevational detail view of an alternative embodiment of the invention wherein weight is borne on a swivel bearing held captive in the base.

In embodiments wherein weight of teetering member 14 is great, and as illustrated in FIG. 5, a swivel bearing 26 is provided. Swivel bearing 26 is constrained to occupy a cavity 28 formed in base 12. This arrangement limits tilting of teetering member 14 from a vertical direction beyond a predetermined tolerable limit.

Figure 6:
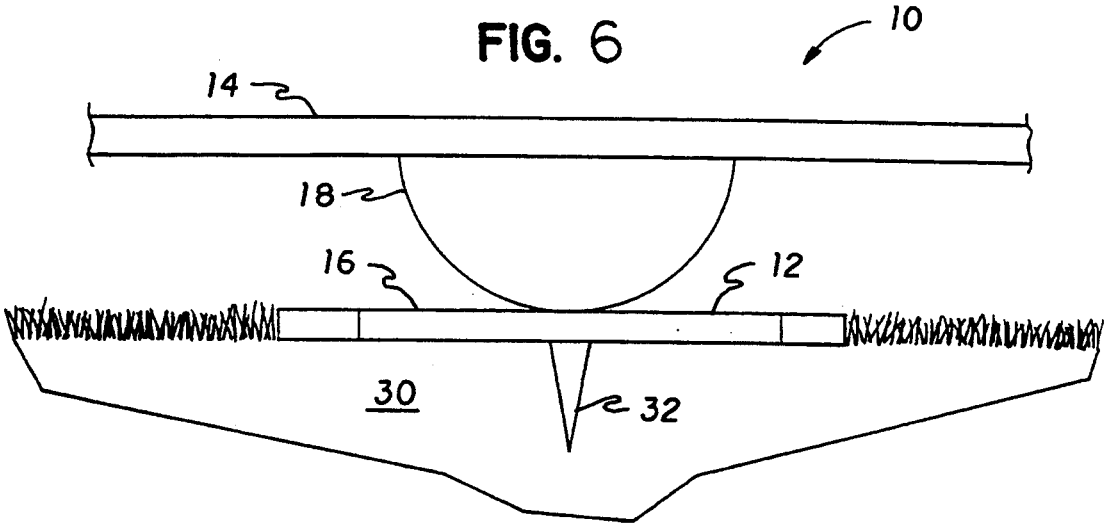
FIG. 6 is a side elevational detail view of an alternative embodiment of the invention, showing a base secured in a ground surface.

Turning now to FIG. 6, one embodiment is contemplated in which base 12 is secured in the ground 30 by a stake 32.

In order to produce motion having sufficient magnitude and variation, static and dynamic inputs are provided. Static inputs are understood to include apparatus which does not require external power directly applied thereto in order to influence rocking, rotation, or both. Examples are seen in FIGS. 7 and 8.

Figure 7:
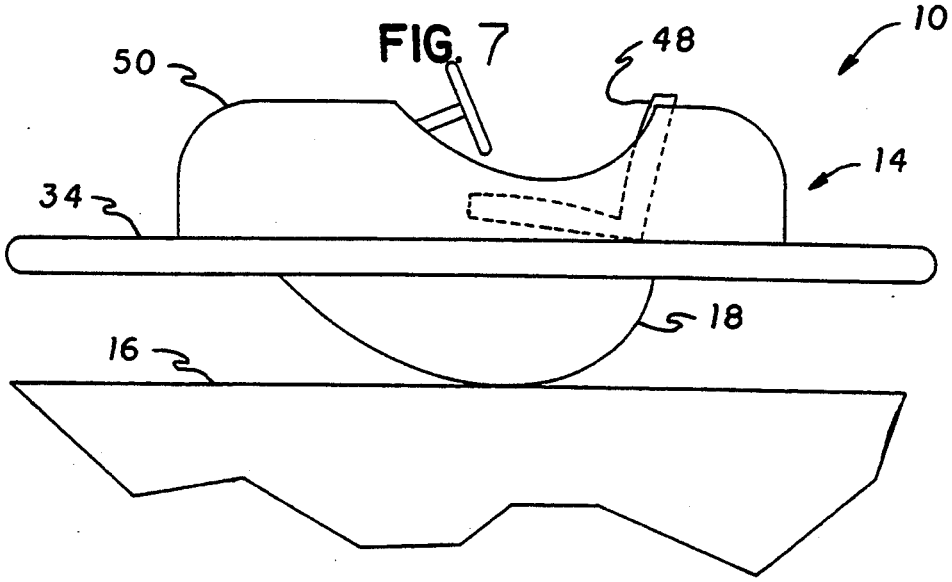
FIG. 7 is a side elevational detail view, showing an asymmetrical counterteetering surface for altering ride characteristics.
Figure 8:
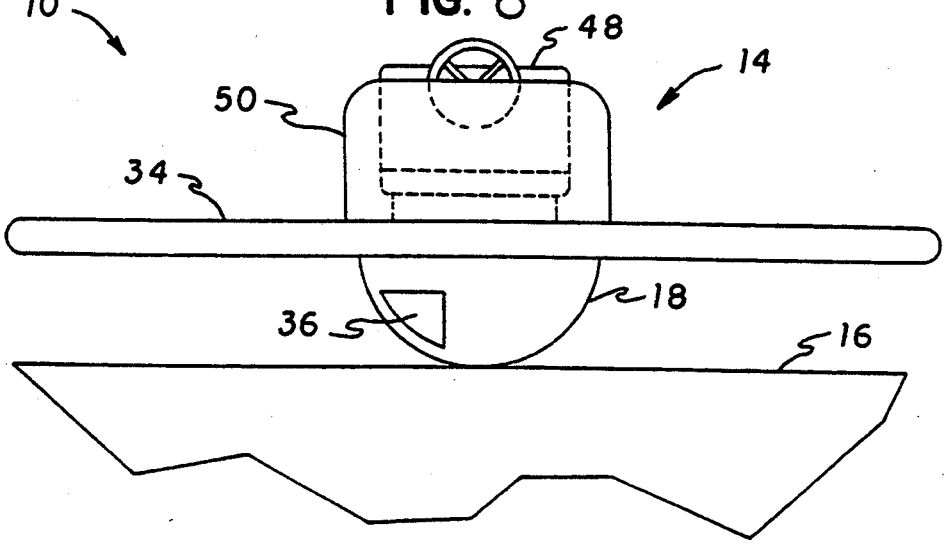
FIG. 8 is a front elevational detail view of an alternative embodiment of the invention wherein an eccentrically located weight alters ride characteristics.

In FIG. 7, surface 18 is seen to be asymmetrical. This characteristic influences rocking motion since the asymmetrical shape causes teetering member 14 to roll in response to the asymmetrical profile of surface 18, and also because the center of mass is altered by the asymmetrical construction. Teetering member 14 will thus rock in motions not discernible to an observer located above a platform 34, which is a component of teetering member 14. FIG. 8 shows a weight 36 concealed eccentrically within teetering member 14. Eccentric location of mass also varies motion unpredictably to an observer.

Figure 9:
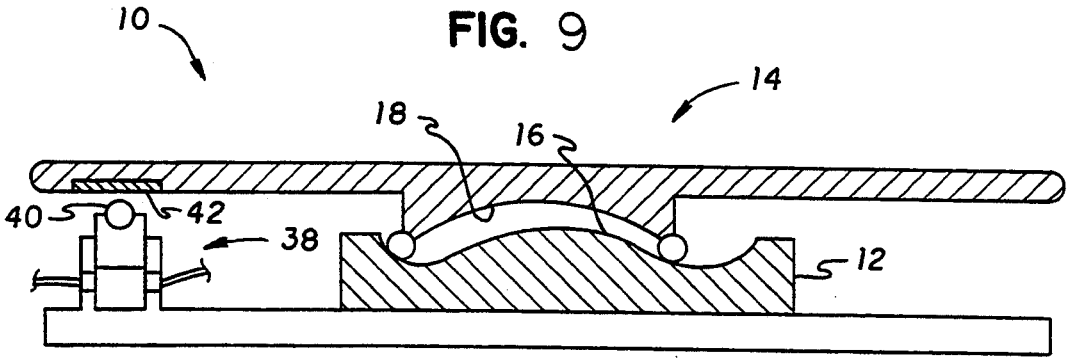
FIGS. 9 and 10 are partly cross sectional, side detail views of the invention showing dynamic inputs.
Figure 10:
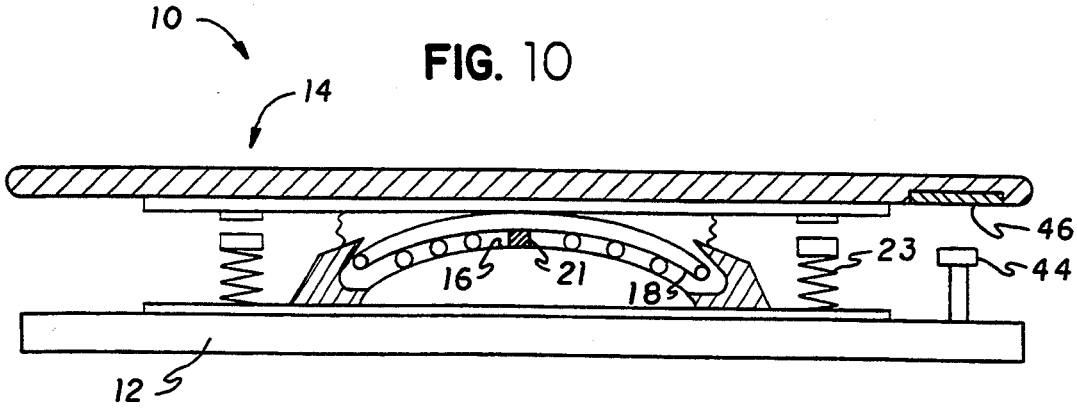

Dynamic inputs are also used to alter motion of teetering member 14. Dynamic inputs are understood to include externally powered devices exerting a force on teetering member 14, and are exemplified in FIGS. 9 and 10. FIG. 9 illustrates a drive motor 38 that contacts a wear resistant member 42 fixed to platform 34. Thus, teetering member 14 is spun about surface 16 when drive motor 38 operates. FIG. 10 shows an electromagnet or hydraulic ram device 44 which acts on responsive member 46. Again, teetering member 14 is subjected to a vertical force altering its inclination, which is further altered by recovery springs 23.

The preferred application of the invention is in the field of amusement rides. Referring again to FIGS. 7 and 8, a seat 48 and a partially surrounding body 50 are provided on teetering member 14 to accommodate a rider. In this embodiment, variable motion device 10 is powered entirely by the rider, and includes static inputs to vary initial motion.

Figure 11:
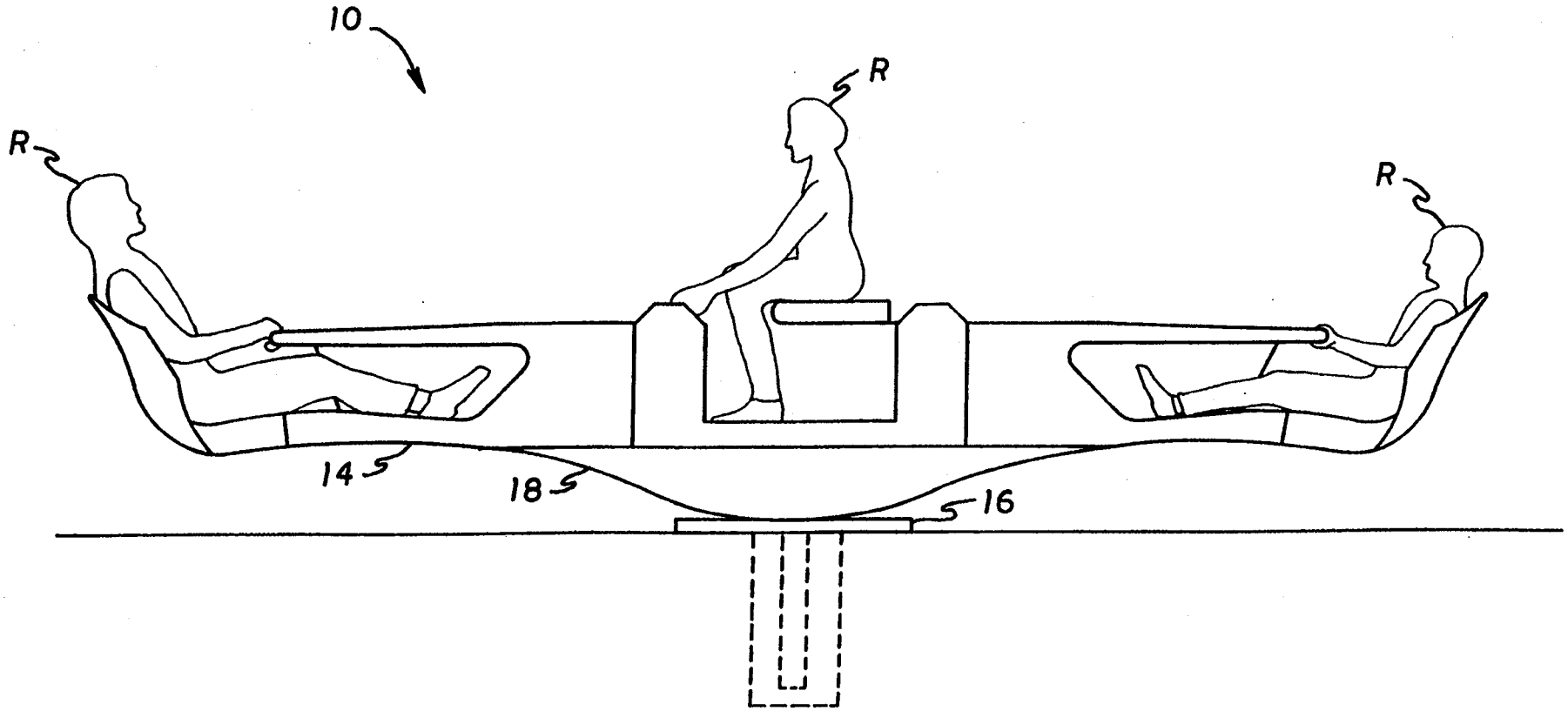
FIG. 11 is a side elevational view of an alternative embodiment of the invention, the seats and surrounding body being configured to accommodate three riders.
Figure 12:
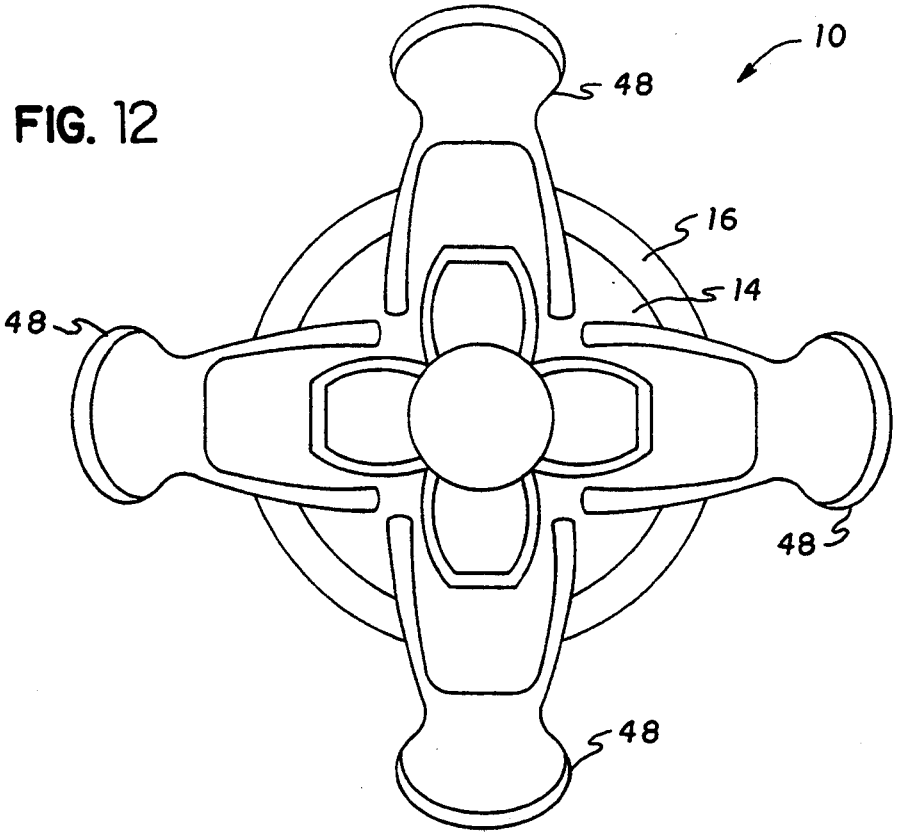
FIG. 12 is a top plan view of an alternative embodiment of the invention, the seat and surrounding body being configured to accommodate four riders.

In further alternative embodiments, as illustrated in FIGS. 11 and 12, variable motion device 10 is configured to accommodate plural riders R. Another seating configuration is shown in FIG. 12, wherein four seats 48 are provided.

Figure 13:
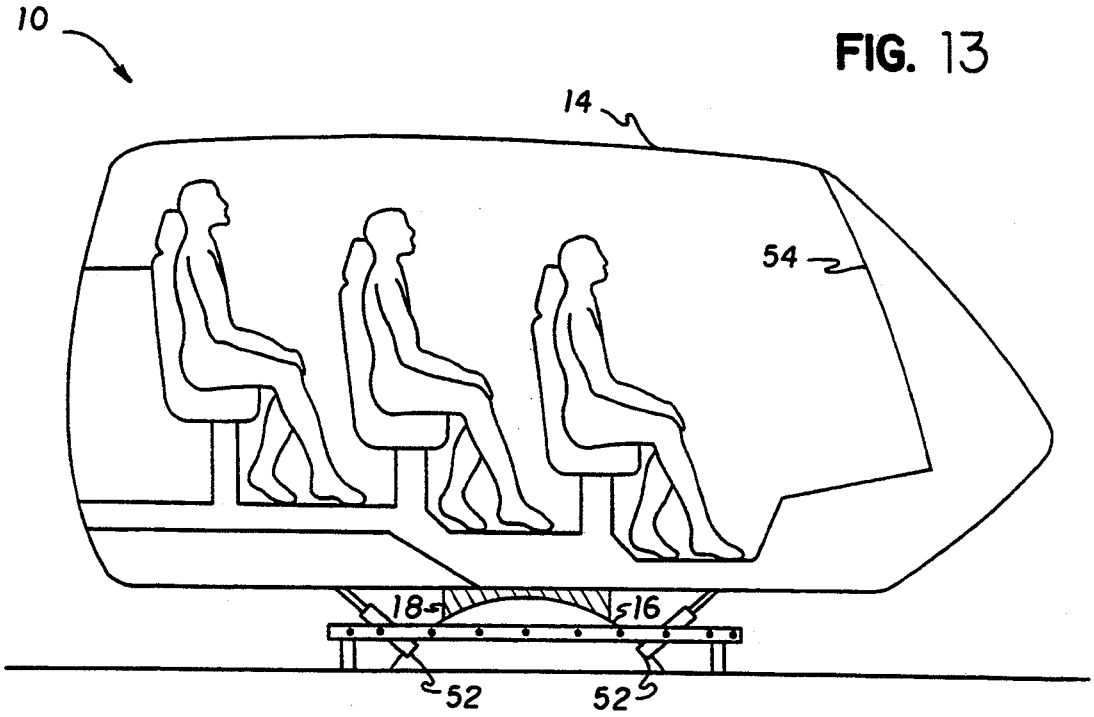
FIG. 13 is a side elevational view, partly broken away, of another alternative embodiment of the invention, illustrating an enclosed body.

In a still further embodiment, shown in FIG. 13, a variable motion device 10 includes an enclosed teetering member 14 teetering on a teetering surface 16, and including hydraulic rams 52 which are coordinated to extend and retract in a preprogrammed sequence to provide motion complementary to a video display 54.

Figure 14:
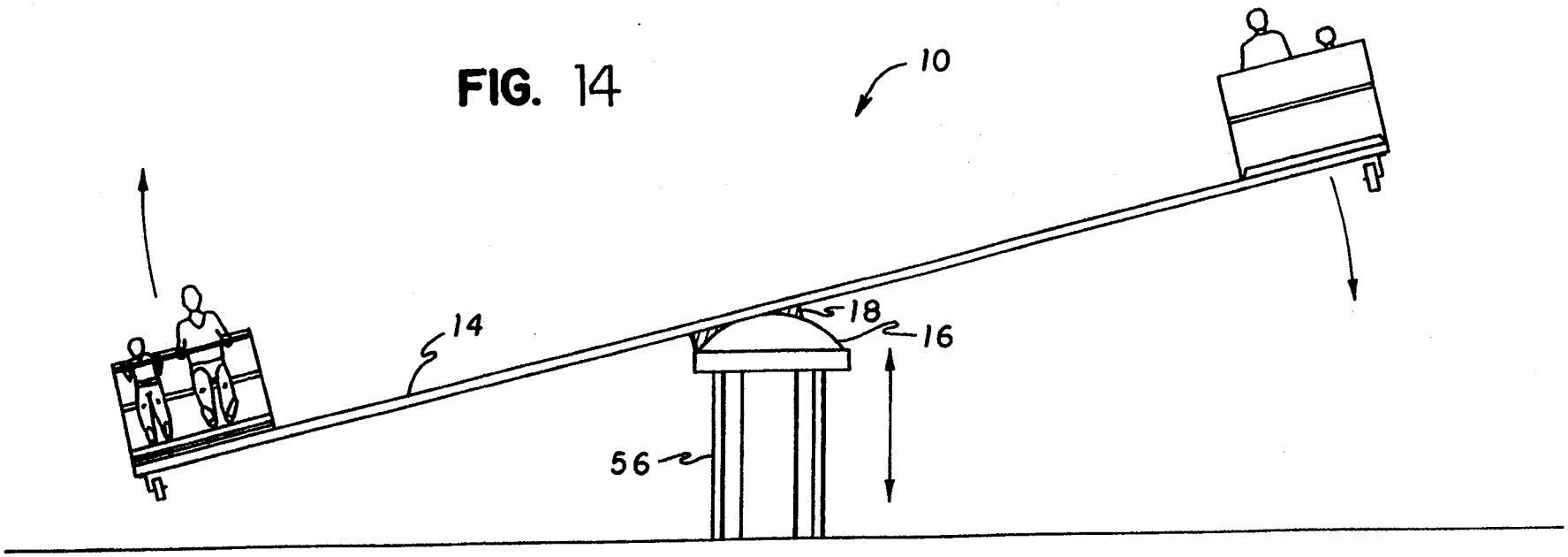
FIG. 14 is a side elevational detail view of the invention illustrating a powered alternative embodiment thereof.

In an embodiment wherein an amusement ride provided by variable motion device 10 is large and wherein rotation is powered, as seen in FIG. 14, ride characteristics are determined by interplay of curvature of teetering surface 16, counterteetering surface 18, and lift and drop of hydraulic lift 56.

As the present invention may be practiced in any one of the embodiments as presented above, or in any combination thereof, or in embodiments not specifically described herein, it is to be understood that the present invention is not limited to the embodiments described above, but encompasses any and all embodiments within the scope of the following claims.

I claim:

1. A variable motion device comprising:

a stationary base including a teetering surface having a cavity;

a moving platform including a counterteetering surface and a geometric center, said moving platform being rotatably and rockably supported on said stationary base said teetering surface contacts and interacts with said counterteetering surface to enable rotation and rocking of said moving platform with respect to said stationary base; and said moving platform further includes means for limiting movement of said platform from a vertical direction beyond a predetermined limit, said means for limiting occupies said cavity and said means for limiting is constrained by said cavity.

2. A variable motion device comprising:

a stationary base having a convex curvilinear surface;

a platform including a concave surface substantially conforming to said convex curvilinear surface;

means for separating said convex curvilinear surface from said concave surface and for allowing said platform to move with respect to said base to provide a teetering motion by allowing said concave surface to slide along said convex curvilinear surface of said base; and means for limiting the motion of said platform with respect to said base.

3. A variable motion device comprising:

a stationary base having a convex curvilinear surface;

an elongate platform having a concave surface substantially conforming to said convex curvilinear surface;

means for separating said convex curvilinear surface from said concave surface and for allowing said platform to move with respect to said base to provide a teetering motion by allowing said concave surface to slide along said convex curvilinear surface of said base; and means for dynamically altering the motion of said platform with respect to said base.

* * * * *